US005949384A

United States Patent [19]

Ikushima

[11] Patent Number: 5,949,384

[45] Date of Patent: Sep. 7, 1999

[54] ANTENNA APPARATUS

[75] Inventor: Akio Ikushima, Chiba, Japan

[73] Assignee: Sony Corporation, Tokyo, Japan

[21] Appl. No.: 09/049,083

[22] Filed: Mar. 27, 1998

[30] Foreign Application Priority Data

Mar. 31, 1997 [JP] Japan ..... 9-081205

[51] Int. Cl.[6] ..... H01Q 7/00

[52] U.S. Cl. ..... 343/866; 343/867; 343/868

[58] Field of Search ..... 343/866, 867–868, 343/741, 742, 878, 720, 712, 702; H01Q 7/00

[56] References Cited

U.S. PATENT DOCUMENTS

| | | | |
|---|---|---|---|
| 2,307,805 | 1/1943 | Scnell | 343/702 |
| 2,419,673 | 4/1947 | Busignies et al. | 343/867 |
| 4,494,123 | 1/1985 | Moore et al. | 343/900 |
| 4,815,784 | 3/1989 | Zheng | 296/97.7 |
| 5,602,556 | 2/1997 | Bowers | 343/742 |

FOREIGN PATENT DOCUMENTS

| | | | |
|---|---|---|---|
| 912583 | 3/1954 | Germany | 343/867 |

OTHER PUBLICATIONS

Russian Abstract RU 2038661.

*Primary Examiner*—Michael C. Wimer
*Assistant Examiner*—Jennifer H Malos
*Attorney, Agent, or Firm*—Jay H. Maioli

[57] ABSTRACT

An antenna apparatus for receiving an electric wave, includes an antenna element for receiving an electric wave made from an elastic linear body of a loop shape which can be collapsed into a plurality of loops of a smaller diameter; a shape retaining member made from a sheet-shaped member such as cloth and spread inside the antenna element so as to maintain a spread state of the antenna element spread into a loop shape; and connection means for connecting the antenna element to an external device. Because the antenna element can be collapsed into a plurality of loops of a smaller diameter, the antenna apparatus can be reduced into a smaller size for carrying.

12 Claims, 7 Drawing Sheets

ANTENNA APPARATUS

BACKGROUND OF THE INVENTION

1. Field of the Invention

The present invention relates to an antenna apparatus used for receiving an electric wave and more particularly, to a portable antenna apparatus having a collapsible loop-shaped antenna element.

2. Description of the Prior Art

A signal receiving apparatus such as a radio receiver for receiving a radio broadcast has an antenna apparatus for receiving a broadcast electric wave. As an antenna apparatus of this type, there can be exemplified a rod antenna apparatus constituted by a plurality of rod-shaped antenna members connected to one another so as to be extended and contracted as a whole, and a loop antenna apparatus having a reception surface defined by a linear antenna element formed in a single loop shape.

A portable radio receiver normally has a rod antenna apparatus which can be contained unitarily with the receiver main body, in order to promote easiness for carrying. The rod antenna apparatus has a plurality of rod-shaped antenna elements which are connected in such a manner that they can be extended and contracted as a whole. When not in use, they are contracted so as to be contained in the apparatus main body for easiness of carrying the radio receiver. The rod type antenna apparatus provided in a radio receiver is extended when receiving a radio broadcast so that a broadcast electric wave can be advantageously received.

As in the rod antenna apparatus, a plurality of antenna elements are extended in when the straight line, the antenna may readily collide with something while carrying the radio receiver. When subjected to a shock by collision, the rod antenna apparatus formed by a plurality of antenna elements of thin rod shape connected to each other is easily bent and further may be broken in the middle.

On the other hand, the loop antenna can improve the reception sensitivity in proportion to the reception area surrounded by the antenna element curved into an almost loop shape. However, if the loop diameter of the antenna element is increased so as to increase the reception sensitivity, the antenna cannot be used as a portable type radio receiver.

SUMMARY OF THE INVENTION

It is therefore an object of the present invention to provide an antenna apparatus which improves the electric wave reception sensitivity and has an excellent portability.

The object of the present invention is to provide an antenna apparatus which can be collapsed into a smaller size which can be surely maintained, thus improving the portability.

Another object of the present invention is to provide an antenna apparatus which cannot be easily damaged when subjected to a shock.

Yet another object of the present invention is to provide an antenna apparatus which can maintain a single loop shape and a preferable reception state.

Still yet another object of the present invention is to provide an antenna apparatus which can be installed at a desired position and can receive a desired electric wave in a preferable state.

In order to achieve the aforementioned objects, the antenna apparatus according to the present invention includes: an antenna element for receiving an electric wave made from an elastic linear body of a loop shape which can be collapsed into a plurality of loops of a smaller diameter; a shape retaining member spread inside the antenna element so as to maintain a spread state of the antenna element spread into a loop shape; and connection means for connecting the antenna element to an external device.

The shape retaining member is made from a sheet-shaped member such as a cloth extended so as to cover the entire surface defined by the loop of the antenna element.

The antenna element has both ends connected to a printed circuit board having at least a tuning circuit.

The antenna apparatus further includes a holding mechanism for holding the antenna element in a collapsed state of the plurality of loops of the smaller diameter.

The holding mechanism is provided so as to connect both ends of the antenna element spread into a single loop. The holding mechanism has connection means such as a connection terminal for connection to an external device.

The antenna apparatus further includes a mounting member for mounting on a mounting block.

According to another aspect of the present invention, there is provided an antenna apparatus including: an antenna element for receiving an electric wave made from a flexible linear body of a loop shape; a tape-shaped elastic reinforcing member which is provided along the antenna element and can be collapsed together with the antenna element into a plurality of continuous loops of a smaller diameter a shape retaining member spread inside the reinforcing member so as to maintain a spread state of the reinforcing member spread into a loop shape; and connection means for connecting the antenna element to an external device.

The antenna apparatus further includes a holding mechanism for holding the antenna element and the reinforcing member in a collapsed state of the plurality of loops of the smaller diameter. This holding mechanism is provided so as to connect both ends of the reinforcing member spread into a single loop.

The antenna apparatus having the aforementioned configuration can reduce its reception surface when carried, by collapsing the antenna element and/or the reinforcing member against the elastic force of the antenna element and/or the reinforcing member. When using this antenna apparatus for receiving an electric wave, the antenna element and/or the reinforcing member can easily be spread into a single loop shape by the elastic force of the antenna element and/or the reinforcing element and the tension of the shape retaining member.

Other merits and advantages obtained from the present invention will be made clear in the explanation given below with reference to the attached drawings.

DETAILED DESCRIPTION OF PREFERRED EMBODIMENTS

Hereinafter, description will be directed to an antenna apparatus according to the present invention with reference to the attached drawings.

Figure 1:
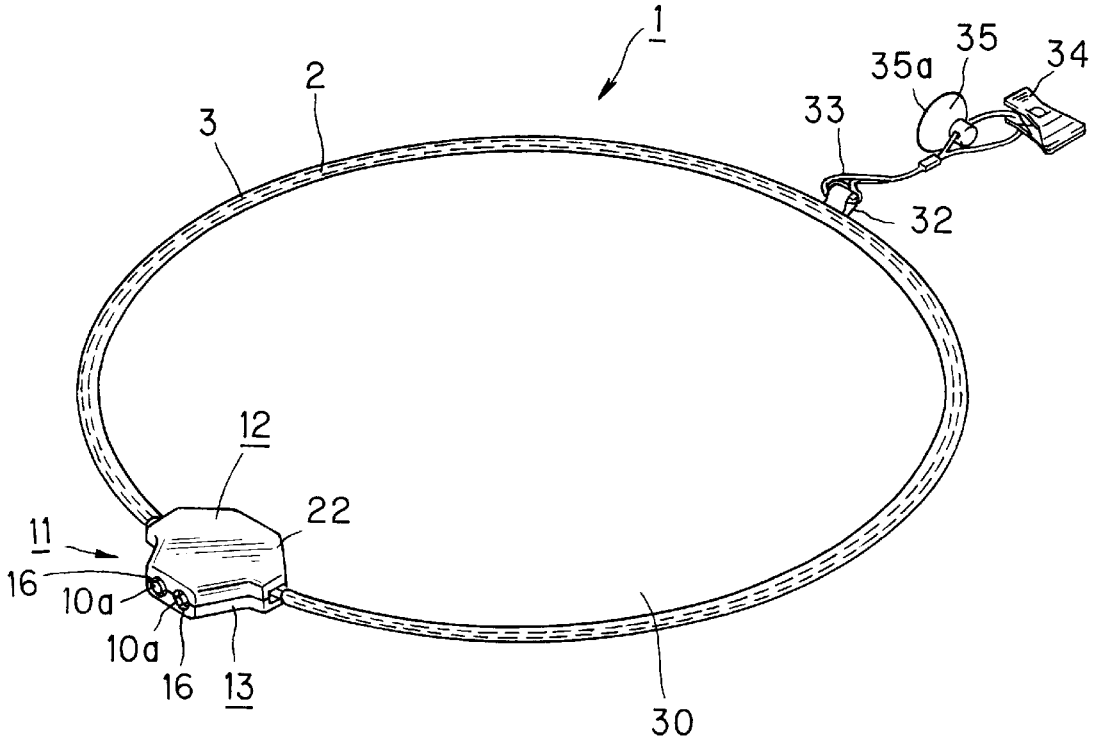
FIG. 1 is a perspective view of an antenna apparatus according to the present invention in a spread state.
Figure 2:
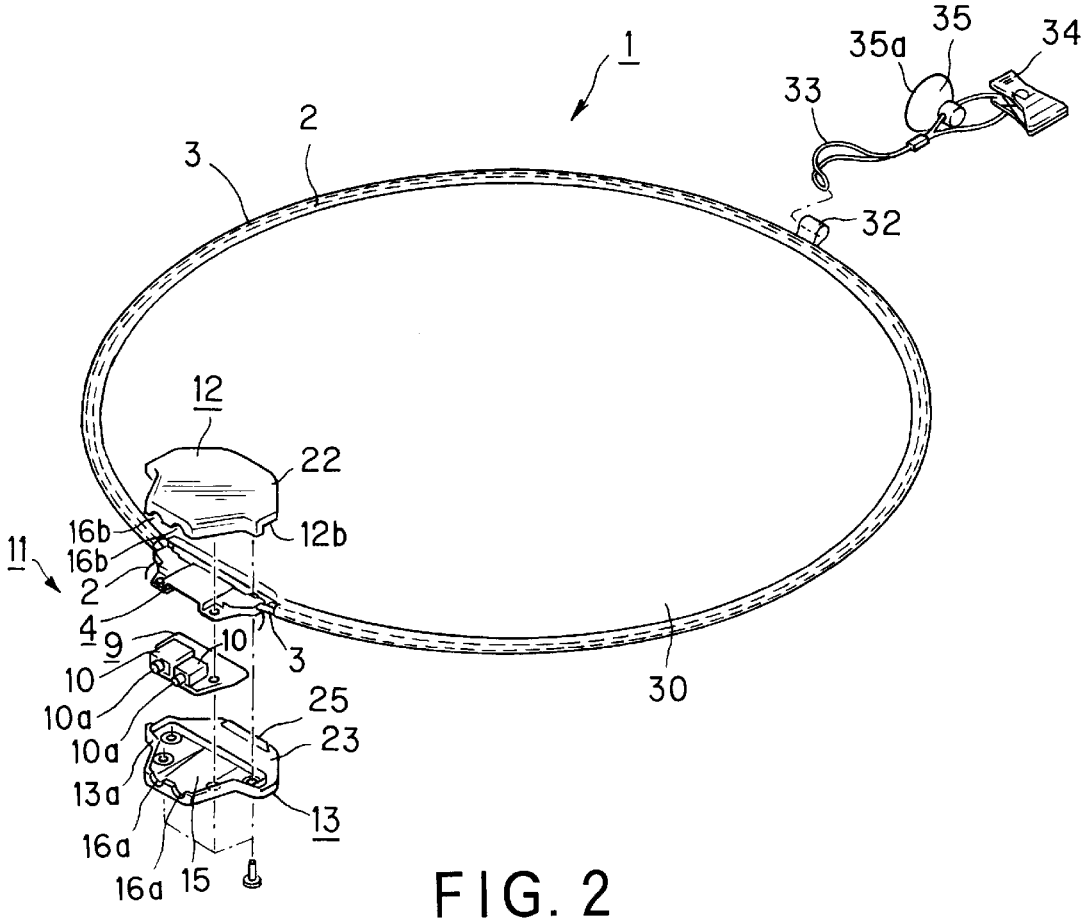
FIG. 2 shows the antenna apparatus according to the present invention with an exploded holding mechanism portion.

As shown in FIG. 1 and FIG. 2, the antenna apparatus 1 according to the present invention has an antenna element 2 spread into a single loop shape and a reinforcing member 3 provided along the antenna element 2.

Figure 3:
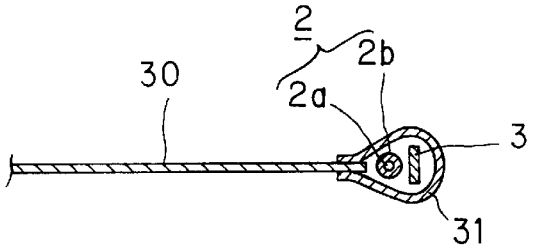
FIG. 3 is a cross sectional view showing an antenna element and a reinforcing member constituting the antenna apparatus according to the present invention.

As shown in FIG. 3, the antenna element 2 is formed from a flexible bar-shaped body having a conductive line material 2*a* such as a copper wire covered with an electrically insulating cladding material 2*b* such as a synthetic resin and cloth. The reinforcing member 3 is made from an elastic thin tape-shaped metal band such as steel or stainless steel. This reinforcing member 3, as shown in FIG. 3, has a rectangular cross section having such an orientation that an elastic deformation is comparatively easily generated in the longitudinal direction.

Figure 4:
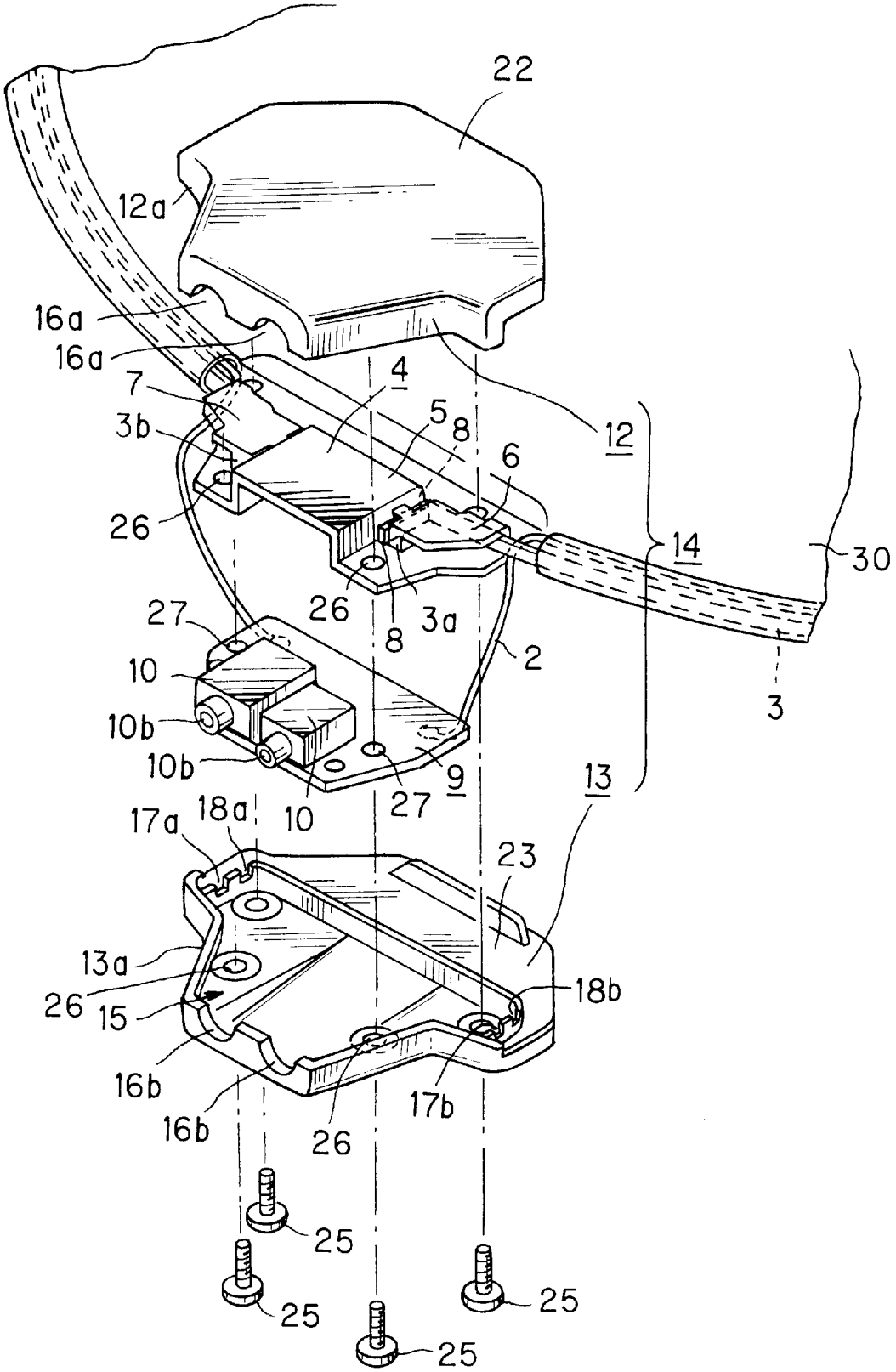
FIG. 4 is an exploded perspective view showing the holding mechanism portion.

As shown in FIG. 2 and FIG. 4, the tape-shaped reinforcing member 3 has both ends connected to a connection member 4 so as to be formed into a single loop shape. The connection member 4 is made by molding a synthetic resin and, as shown in FIG. 4, has reinforcing member support blocks 6 and 7 of grooved shape into which the ends of the reinforcing member 3 are to be inserted. At the bottom of each of the reinforcing member support blocks 6 and 7 is provided an engagement hole 8 to be engaged with an engagement piece 3*a*, 3*b* formed by the end of the reinforcing member 3 which has been bent. The reinforcing member 3 is connected to the connection member 4 with its ends inserted into the reinforcing member support blocks 6 and 7 and engaged with the engagement pieces 3*a* and 3*b* with the engagement holes 8, forming a single loop shape as shown in FIG. 2.

Moreover, as shown in FIG. 2 and FIG. 4, the antenna element 2 is electrically and mechanically connected by using a conductive adhesive such as solder to a wiring pattern formed on a printed circuit board 9 mounted on a main body 5 of the connection member 4. The antenna element 2 with its both ends connected to the printed circuit board 9 forms a loop shape.

The printed circuit board 9 has an antenna circuit including a tuning circuit and a high frequency amplifier as will be detailed later. The antenna element 2 is electrically connected to the antenna circuit when connected to the wiring pattern. As shown in FIG. 4, the printed circuit board 9 has a pair of jacks 10 which constitute connection means where a connection plug is connected for connection to a controller used for connecting the antenna apparatus according to the present invention to a radio receiver.

Figure 5:
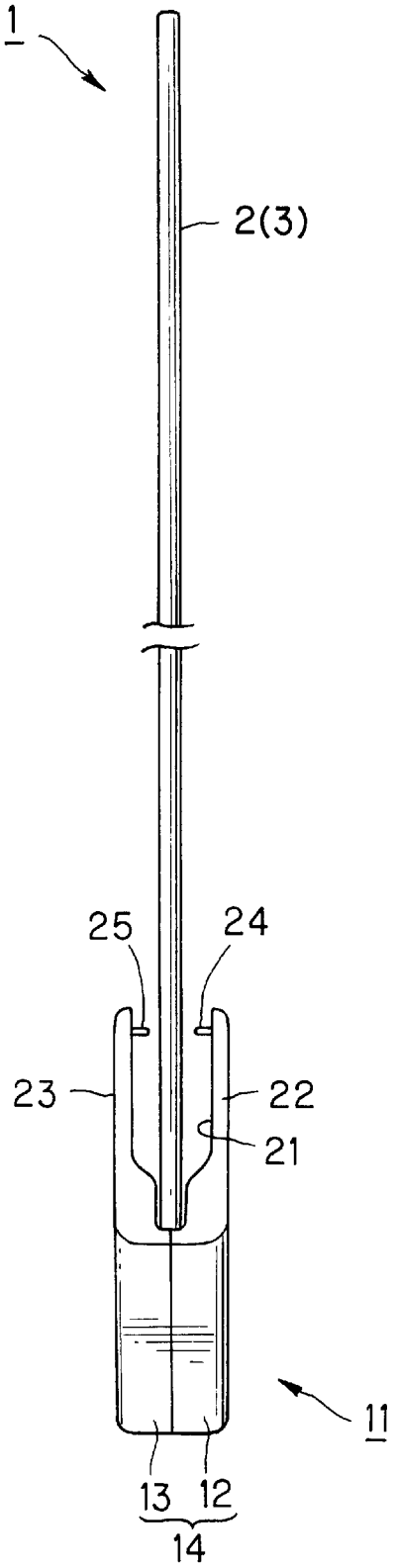
FIG. 5 is a side view showing the antenna apparatus according to the present invention in the spread state.

As shown in FIG. 1 and FIG. 2, the antenna apparatus according to the present invention has a holding mechanism 11 for holding the antenna element 2 and the reinforcing member 3 folded into a plurality of loop shapes of smaller diameter, in such a manner that the holding mechanism 11 covers the connection member 4 connecting the both ends of the reinforcing member 3 and the both ends of the reinforcing member 3 connected to the connection member 4. As shown in FIG. 4 and FIG. 5, this holding mechanism 11 has a holder 14 formed by an upper holder body 12 and a lower holder body 13 provided so as to oppose each other. The upper holder body 12 has a circumferential wall 12*a* on its inner surface and the lower holder body 13 has a circumferential wall 13*a* on its inner surface. These circumferential walls 12*a* and 13*a* define a connection member containing space 15. In this connection member containing space 15 is contained the connection member 4 together with the printed circuit board 9 having the jacks 10, 10.

As shown in FIG. 4, the walls 12*a* and 13*a* have cut-off portions 16*a* and 16*b* so as to define insert holes 16, 16 when the upper holder body 12 and the lower holder body 13 are brought into abutment. These insert holes 16, 16 are provided so as to expose outwardly plug insert blocks 10*a* and 10*b* of the jacks 10, 10 provided on the printed circuit board 9. Moreover, as shown in FIG. 4, the circumferential walls 12*a* and 13*a* have cut-off portions 17*a*, 17*b* and 18*a*, 18*b*, so as to define a first insert hole 17 for inserting the reinforcing member 3 to be connected to the connection member 4 and a second insert holder 18 for inserting the antenna element 2 to be connected to the printed circuit board 9.

As shown in FIG. 5, holder pieces 22 and 23 protrude from the upper and the lower holder bodies 12 and 13 so as to define a holding space 21 for holding the antenna element 2 and the reinforcing member 3 when it is folded into a plurality of loops of a smaller diameter. When the holding bodies 12 and 13 are brought into abutment so as to constitute the holder 12, as shown in FIG. 5, the holding pieces 22 and 23 define the holding space 21 serving as a space for inserting the antenna element 2 and the reinforcing member 3 folded into a plurality of loop shapes of a smaller diameter. As shown in FIG. 4 and FIG. 5, the holding pieces 22 and 23 have stopper pieces 24 and 25, respectively, at their tips, opposing each other so as to prevent removal of the antenna element 2 and the reinforcing member 3 from the holding block 21.

pair of the holder bodies 12 and 13 having the aforementioned configuration are brought into abutment with each other from both sides of the connection member 4 so as to define the connection member containing space 15 to contain the connection member 4 having the printed circuit board 9 connected to the both ends of the antenna element 2, and the pair of holder bodies 12 and 13 are connected to each other with a fixing screw 25 to constitute the holder 14 as shown in FIG. 1 and FIG. 5. This holder 14 contains the connection member 4 having the printed circuit board 9, and the ends of the reinforcing member 3 and the antenna element 2 are pulled out of the holder 14 through the first insert holes 17 and the second insert holes 18 formed in the holder 14. Moreover, the plug insert blocks 10*a*, 10*b* of the jacks 10, 10 provided on the printed circuit board 9 are exposed outward through the insert holes 16, 16 as shown in FIG. 1.

The fixing screws 25 to connect the pair of holder bodies 12 and 13 are inserted into the screw insert holes 26 and 27 formed in the connection member 4 and the printed circuit board 9 so as to connect the holder body 12 to the holder body 13 as well as to connect the connection member 4 and the printed circuit board 9 to the holder bodies 12 and 13.

The antenna apparatus according to the present invention includes a shape retaining member 30 provided to cover the inside of the antenna element 2 and the reinforcing member 3 of a single loop shape, so as to retain the single loop state of the antenna element 2 and the reinforcing member 3. As shown in FIG. 1 and FIG. 2, the shape retaining member 30 is made from a disc-shaped flexible expandable sheet material such as cloth or synthetic resin, covering the entire surface defined by the single loop shape of the antenna element 2 and the reinforcing member 3. As shown in FIG.

3, this shape retaining member 30 is connected by sewing to a surrounding member 31 which wraps the antenna element 2 and the reinforcing member 2, so that the shape retaining member 30 is spread inside the surrounding member 31. The antenna element 2 is wrapped together with the reinforcing member 3 by the surrounding member 31 of the shape retaining member 30 so as to be elastically deformed together with the reinforcing member 3.

The shape retaining member 30 can be made from various sheet-shaped materials including cloth which enables to retain the state of the antenna element 2 and the reinforcing member 3 spread into a single loop shape and which can be folded when the antenna element 2 and the reinforcing member 3 are folded into a plurality of loops of a smaller diameter. This shape retaining member 30 can be made from a sheet member such as a cloth colored black having a comparatively high light shading property, so that the antenna apparatus 1 installed, for example, in a vehicle cabin exposed to sun light, can serve as a parasol to cut off the direct sun light.

As shown in FIG. 1 and FIG. 2, at a position on the outer circumference of the shape retaining member 30 almost opposing to the holding mechanism 11, there is provided a support ring 32 made from cloth or the like through which the antenna apparatus 1 can be hung on a wall or window for receiving an electric wave. To this support ring 32 is attached one end of a support strap 33 for supporting the antenna apparatus 1. This support strap has the other end provided with a clip 34 Moreover, this support strap 33 has in the middle of its length a suction member 35 provided with a suction cup 35*a* at its end to be attached to a flat object such as a window or the like facing outdoors for receiving an electric wave indoors. The suction member 35 has one end which is rotatably supported by the clip 34.

Description will now be directed to a collapsing procedure, i.e., folding of the antenna element 2 and the reinforcing member 3 of the antenna apparatus 1 having the aforementioned configuration and further a spreading procedure of the antenna element 2 and the reinforcing member 3 from the folded state.

Figure 6:
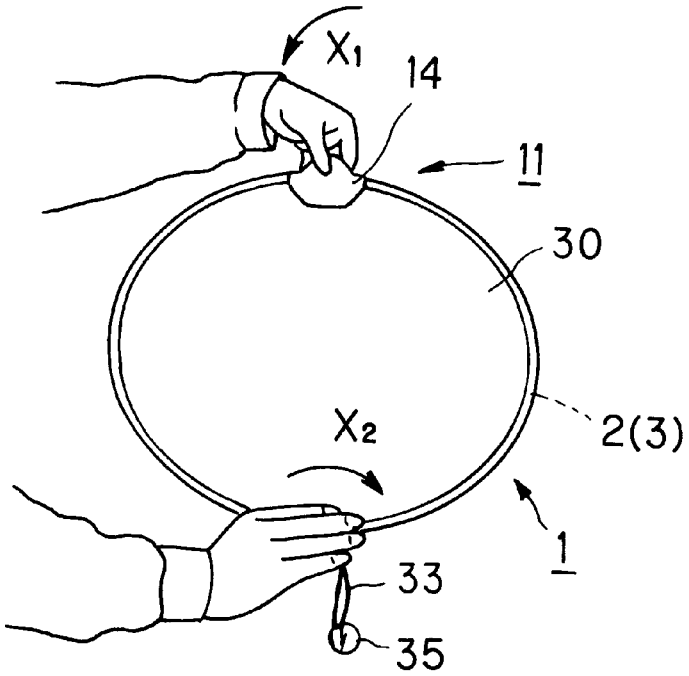
FIG. 6 is a side view showing the antenna apparatus according to the present invention at the start of folding (collapsing) process.
Figure 7:
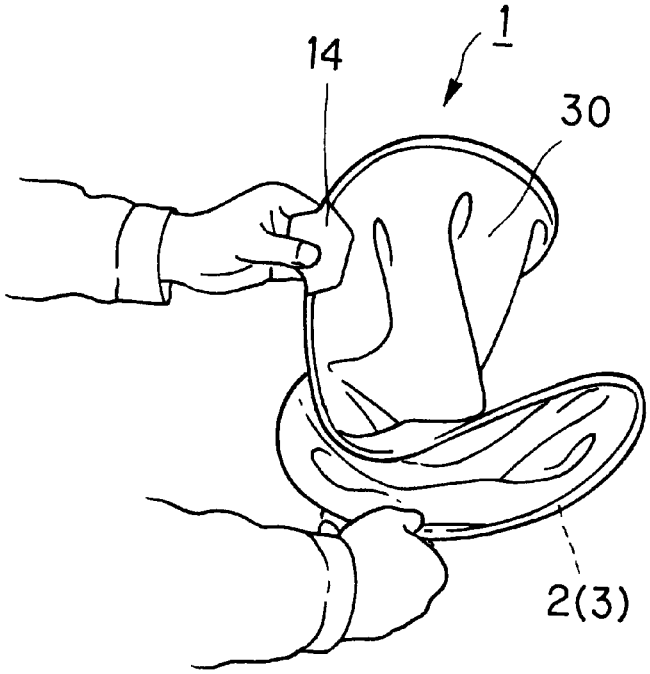
FIG. 7 is a side view showing the antenna apparatus according to the present invention in the state of half-folded, i.e., half-collapsed.

The antenna apparatus with its antenna element 2 and the reinforcing member 3 spread in a single loop shape as shown in FIG. 1 is folded as follows. Firstly, as shown in FIG. 6, a user grasps the holder 14 with one hand and the antenna element 2 together with the reinforcing member 3 at a position opposing to the holder 14 with the other hand. Then, around a virtual rotation axis connecting these two grasping points, the user twists the grasped positions in the direction of arrow X1 and in the reverse direction of arrow X2 in FIG. 6 by 180 degrees. Simultaneously with this, as shown in FIG. 7, one of the grasped positions is moved toward the other grasped position.

Figure 8:
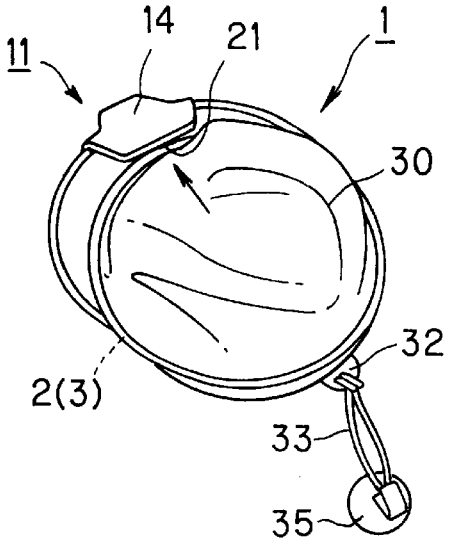
FIG. 8 is a perspective view showing the antenna element folded and held by the holding mechanism portion of the antenna apparatus according to the present invention.
Figure 9:
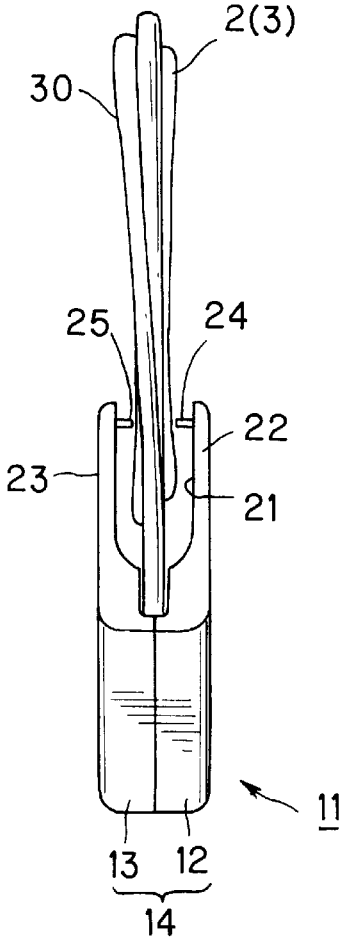
FIG. 9 is a side view showing the antenna element folded and held in the holding mechanism portion of the antenna apparatus according to the present invention.

Against the elastic force of the antenna element 2 and the reinforcing member 3, the grasped positions are further twisted by 180 degrees in the direction of the arrow X1 and the reverse direction of the arrow X2, so that the antenna element 2 and the reinforcing member 3 are folded into three loops of a smaller diameter. Next, as shown in FIG. 8, a portion of the folded antenna element 2 and the reinforcing member 3 positioned at the side of the holding mechanism 11 is inserted and held in the holding space 21 constituted by the pair of holding pieces 22 and 23. Although the antenna element 2 and the reinforcing member 3 inserted into the holding space 21 have an urging force in the direction to spread into a single loop shape, they are supported by the pair of holding pieces 22 and 23 and stopped by the stopper pieces 24 and 25 formed at the tips of the holding pieces 22 and 23 so as to be maintained in the folded state.

The antenna apparatus 1 shown here has the antenna element 2 which is spread into a single loop to define a reception surface having a diameter of about 450 mm. When the antenna element 2 and the reinforcing member 3 are folded into three loops of a smaller diameter as shown in FIG. 8, the diameter of the reception surface of the antenna element 2 becomes about 170 mm, which means that the reception surface of the antenna element 2 is reduced to about ⅖ and the reception surface is reduced to about 1/7. The antenna apparatus 1 with the folded antenna element 2 of a smaller diameter can easily be contained in a bag or the like and is convenient for carrying.

The antenna apparatus 1 collapsed into the smaller diameter of loop shape can be spread as follows. When the portion of the antenna element 2 and the reinforcing member 3 inserted and engaged in the holding space 21 is removed from the holding block 21, the antenna element 2 and the reinforcing member 3 automatically spread with the elastic force of the reinforcing member 21 into the single loop shape as shown in FIG. 1.

Figure 10:
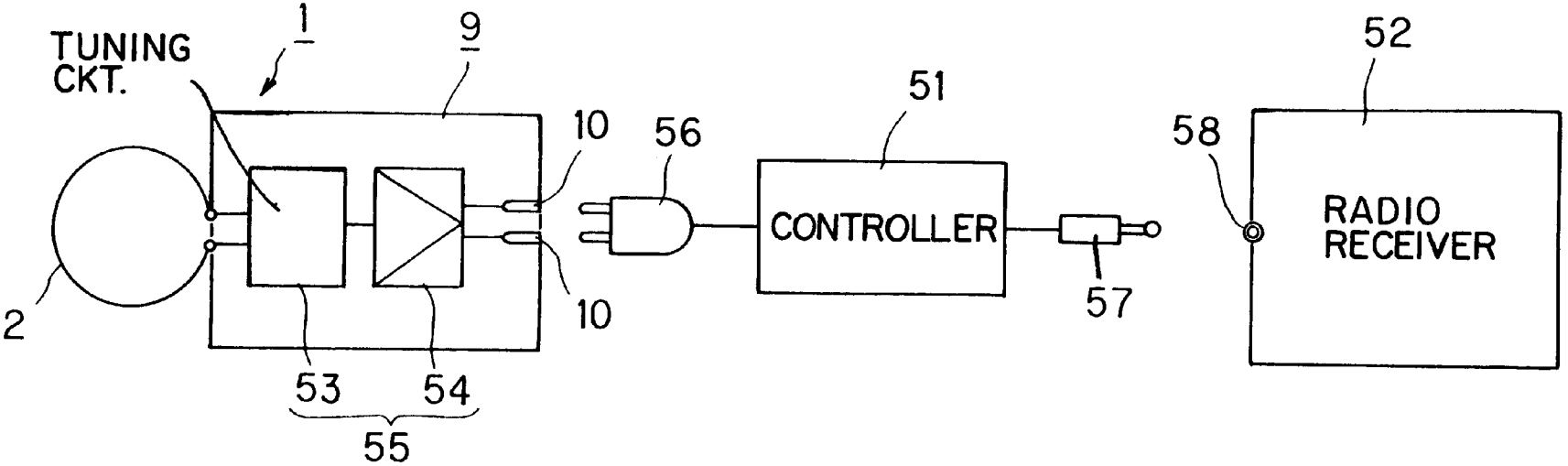
FIG. 10 is a block diagram showing the antenna apparatus according to the present invention connected through a controller to a radio receiver.

The antenna apparatus 1 according to the present invention having the aforementioned configuration is connected via a controller 51 to a radio receiver 52 shown in FIG. 10.

As shown in FIG. 10, the printed circuit board 9 contained in the holder 14 contains an antenna circuit 55 consisting of a tuning circuit 53 and a high frequency amplifier 54. The tuning circuit 53 is made from a variable-capacity diode connected in parallel with the antenna element 2 for receiving high-frequency signals. The high frequency amplifier 54 is supplied with a reception signal selected by the tuning circuit 53 and amplifies this reception signal.

As shown in FIG. 10, the antenna circuit 55 of the antenna apparatus 1 is connected to the controller 51 by connecting a connection plug 56 mounted at the tip of an external connection cord with the jack 10, 10. The controller 51 is used to set a reception frequency band of the antenna apparatus 1 and is provided with a control voltage forming circuit for forming a control voltage for the variable-capacity diode and a power source such as a primary battery for driving the antenna circuit 55 of the antenna apparatus 1 and the control voltage circuit. As shown in FIG. 10, the controller 51 is connected to the radio receiver 52 by connecting a connection plug 57 provided at a tip of an external connection cord to a connection terminal 58 provided on the radio receiver 52.

When the antenna apparatus 1 is connected to the radio receiver 52 as has been described above, a broadcast electric wave received by the antenna apparatus 1 is supplied to the radio receiver 52 and outputted as an acoustic sound from a loudspeaker provided on the radio receiver 52.

The antenna apparatus 1 according to the present invention is spread into a single loop shape, increasing the reception surface and enabling to preferably receive a broadcast electric wave of a weak electric field.

The aforementioned antenna apparatus 1 has the flexible antenna element 2, along which is provided the reinforcing member 3 which can be elastically displaced. However, it is also possible to make the antenna element 2 itself from a member which can be elastically displaced, omitting the reinforcing member 3. That is, the antenna element may be constituted by a material identical to the aforementioned reinforcing member.

In the above explanation, the antenna apparatus 1 according to the present invention is used for receiving a broadcast electric wave of a short wave band. However, the present invention is not to be limited to a broadcast electric wave of a short wave band but can be preferably applied for receiving an electric wave of other frequency bands.

Furthermore, the antenna apparatus 1 according to the present invention can be preferably used not only for receiving an electric wave of broadcast but also an electric wave for data communication.

As has been described above, the antenna apparatus according to the present invention can be maintained in a spread state of a single loop of a large diameter and a collapsed state having a plurality of loops of a smaller diameter, and accordingly enables to obtain a preferable reception sensitivity for receiving an electric wave as well as to improve easiness for carrying. Moreover, the antenna element can be maintained by the holding mechanism in the collapsed state, i.e., in the folded state, which further improves the easiness for carrying. Furthermore, the antenna element spread into a single loop of a large diameter is held in the spread state by the shape retaining member, which enables to maintain the single loop shape and to obtain a preferable reception state. Moreover, the antenna apparatus according to the present invention can be installed at any desired position for preferably receiving a desired electric wave.

What is claimed is:

1. An antenna apparatus for receiving an electric wave, said apparatus comprising:

an antenna element for receiving the electric wave made of a flexible linear electrical conductor formed in a loop shape of a predetermined diameter and which is collapsible into a plurality of loops of a smaller diameter than said predetermined diameter;

a shape retaining member spread inside the perimeter of the loon shape of said antenna element so as to maintain said antenna element spread into said loop shape of said predetermined diameter; and connection means for electrically connecting said antenna element to an external device, wherein said shape retaining member is made from a sheet-shaped member extended so as to cover an entire surface defined by said loop shape of said antenna element.

2. The antenna apparatus as claimed in claim 1, wherein said antenna element has two ends, each connected to a printed circuit board having at least a tuning circuit.

3. The antenna apparatus as claimed in claim 1, further comprising a mounting member for mounting said antenna element to an external surface.

4. An antenna apparatus for receiving an electric wave, said apparatus comprising:

an antenna element for receiving the electric wave made of a flexible linear electrical conductor formed in a loop shape of a Predetermined diameter and which is collapsible into a plurality of loops of a smaller diameter than said predetermined diameter;

a shape retaining member spread inside the perimeter of the loop shape of said antenna element so as to maintain said antenna element spread into said loop shape of said predetermined diameter;

connection means for electrically connecting said antenna element to an external device; and a holding mechanism for holding said antenna element collapsed into said plurality of loops of the smaller diameter.

5. The antenna apparatus as claimed in claim 4, wherein said holding mechanism includes means for holding two ends of said antenna element.

6. The antenna apparatus as claimed in claim 4, wherein said holding mechanism has mounted thereon said connection means for connection to said external device.

7. An antenna apparatus for receiving an electric wave, said apparatus comprising:

an antenna element for receiving the electric wave made of a flexible linear electrical conductor of a loop shape having a predetermined diameter;

an elastic reinforcing tape provided along said loop shape of said antenna element and which is collapsible together with said antenna element into a plurality of continuous loops of a diameter smaller than said predetermined diameter;

a shape retaining member spread inside the perimeter of said reinforcing tape so as to maintain a spread state of said reinforcing tape in said loop shape; and connection means for electrically connecting said antenna element to an external device, wherein said shape retaining member is made from a sheet-shaped member extending to cover an entire surface defined by said loop shape of said reinforcing tape.

8. The antenna apparatus as claimed in claim 7, wherein said antenna element has two ends, each connected to a printed circuit board having at least a tuning circuit.

9. The antenna apparatus as claimed in claim 7, further comprising a mounting member for mounting said antenna element to an external surface.

10. An antenna apparatus for receiving an electric wave, said apparatus comprising:

an antenna element for receiving the electric wave made of a flexible linear electrical conductor of a loop shape having a predetermined diameter;

an elastic reinforcing tape provided along said loop shape of said antenna element and which is collapsible together with said antenna element into a plurality of continuous loops of a diameter smaller than said predetermined diameter;

a shape retaining member spread inside the perimeter of said reinforcing tape so as to maintain a spread state of said reinforcing tape in said loop shape;

connection means for electrically connecting said antenna element to an external device; and a holding mechanism for holding said antenna element and said reinforcing tape collapsed into said plurality of loops of the smaller diameter.

11. The antenna apparatus as claimed in claim 10, wherein said holding mechanism includes means for holding two ends of said reinforcing tape.

12. The antenna apparatus as claimed in claim 10, wherein said holding mechanism has mounted thereon said connection means for connection to said external device.

* * * * *